US007543614B2

(12) United States Patent
Wise

(10) Patent No.: US 7,543,614 B2
(45) Date of Patent: Jun. 9, 2009

(54) COLLAPSIBLE INFEED/OUTFEED TABLE

(76) Inventor: Robert W. Wise, 365 Ely Rd., Petaluma, CA (US) 94954

( * ) Notice: Subject to any disclaimer, the term of this patent is extended or adjusted under 35 U.S.C. 154(b) by 199 days.

(21) Appl. No.: 11/724,003

(22) Filed: Mar. 13, 2007

(65) Prior Publication Data

US 2008/0282941 A1 Nov. 20, 2008

(51) Int. Cl.
*B25H 1/02* (2006.01)

(52) U.S. Cl. ..... 144/286.5; 144/287; 108/36; 108/50.17; 108/69

(58) Field of Classification Search ..... 144/286.1, 144/286.5, 287; 108/35, 36, 50.17, 69, 132, 108/169

See application file for complete search history.

(56) References Cited

U.S. PATENT DOCUMENTS

| | | | | |
|---|---|---|---|---|
| 1,601,250 | A | 9/1926 | Hilderbrand | |
| 2,544,220 | A | 3/1951 | Concklin | |
| 2,784,004 | A | 3/1957 | Hamrick, Jr. | |
| 3,147,748 | A | 9/1964 | Frank | |
| 3,669,031 | A | 6/1972 | Cole | |
| 4,230,329 | A | 10/1980 | Johnson | |
| 4,284,286 | A | 8/1981 | Lewallen | |
| 4,565,382 | A | 1/1986 | Sherman | |
| 4,643,103 | A * | 2/1987 | Jorgensen | 108/36 |
| 4,934,718 | A | 6/1990 | Voegele | |
| 4,974,651 | A * | 12/1990 | Carmon et al. | 144/286.1 |
| 5,154,441 | A | 10/1992 | White et al. | |
| 5,320,150 | A | 6/1994 | Everts | |
| 5,536,034 | A | 7/1996 | Miller | |
| 5,863,052 | A | 1/1999 | Roman | |
| 5,957,472 | A | 9/1999 | Borgatti | |
| 6,328,319 | B1 | 12/2001 | Stahler, Sr. | |
| 6,345,829 | B1 | 2/2002 | Mueller | |
| 6,364,328 | B1 | 4/2002 | Stahler, Sr. | |
| 6,530,583 | B1 | 3/2003 | Mueller | |
| 6,578,856 | B2 | 6/2003 | Kahle | |
| 6,886,836 | B1 | 5/2005 | Wise | |
| D535,491 | S | 1/2007 | Wise | |
| 2002/0125662 | A1 | 9/2002 | Magness | |
| 2004/0250903 | A1 * | 12/2004 | Welsh | 144/286.5 |

* cited by examiner

*Primary Examiner*—Shelley Self
(74) *Attorney, Agent, or Firm*—Black Lowe & Graham PLLC

(57) ABSTRACT

A collapsible infeed/outfeed table is provided with a pair of collapsible wings that are supported by struts slidably attached to the wings and pivotally attached to two pairs of elongated support legs. A pair of vertical stanchions provide a pivot point for the wings and lower ends thereof support a pair of sliding braces also connected to the extensible legs. A central roller is provided between the two wings that telescope between an extended and a retracted position. Extensible rollers are provided at free ends of the wings such that, when extended, the table may serve as a crosscut saw support stand. With the wings retracted and the central roller raised, the table may serve as an infeed/outfeed roller support for a separate saw, such as a crosscut saw or table saw. Finally, with all of the rollers retracted and the wings extended, the table is a work table.

11 Claims, 5 Drawing Sheets

COLLAPSIBLE INFEED/OUTFEED TABLE

TECHNICAL FIELD

The invention relates to collapsible workbenches. More specifically, the invention relates to collapsible work tables, infeed/outfeed tables, and mobile stands for power tools.

BACKGROUND OF THE INVENTION

Portable, wheeled tool carts have been available for some time. One such prior art tool cart is shown and described by Wise, the inventor herein, in U.S. Pat. No. 5,642,898, issued Jul. 1, 1997. Additional tool carts have been described in the patent literature. For instance, U.S. Pat. No. 4,955,941, issued Sep. 11, 1990, to Rousseau, describes a support table for a bench saw. U.S. Pat. No. 4,230,329, issued Oct. 28, 1980 to Johnson, describes a mobile cart. U.S. Pat. No. 5,161,590, issued Nov. 10, 1992, to Otto, describes a miter saw table apparatus. U.S. Pat. No. 5,255,724, issued Oct. 26, 1993, to Butke, describes an adjustable extension assembly. A brochure showing the Rousseau SS2850 product discloses a mobile miter saw stand.

U.S. Design Patent No. D535,491 issued Jan. 23, 2007 to the inventor herein entitled "Convertible Work Bench", discloses a collapsible work table that is suitable for supporting a powered saw such as a miter saw, chop saw, or other crosscut type of saw. That work bench includes adjustable infeed and outfeed bars for supporting an elongated workpiece to be crosscut. The inventor herein has further been issued U.S. Pat. No. 6,886,836 on May 3, 2005 titled "Counterbalanced Universal Mobile Saw Stand" that is particularly well adapted for supporting a powered crosscut saw in both an elevated position for working at standing height, and a collapsed position for working adjacent the floor, such as when mitering floor moldings for carpentry. The disclosed device is also well adapted for transporting a powered saw, such as a chop saw or the like to and from a work site. Thus, the above prior art discloses a wide range of configurations for infeed/outfeed tables, collapsible saw support stands, collapsible work tables, and portable infeed/outfeed tables. Further, those of ordinary skill in the art are aware of clamp-like devices supporting elongated rollers that may be attached to conventional sawhorses for use as infeed/outfeed supports for materials to be crosscut. It is also known that sawhorses may be of the collapsible, reusable type.

Nevertheless, none of the above prior art devices are well adapted for performing all of these functions in a single, lightweight device.

Thus, a need exists for a collapsible work stand that can also serve as an infeed/outfeed table for supporting materials to be crosscut, a lightweight collapsible work surface, and a powered tool support table.

SUMMARY OF THE INVENTION

It is therefore an object of the present invention to provide a collapsible infeed/outfeed table for supporting materials to be crosscut.

It is a further object of the present invention to provide a collapsible infeed/outfeed table that achieves the above object and which also can be configured to act as a support table for a powered crosscut type of saw.

It is yet another object of the present invention to provide a collapsible infeed/outfeed table that achieves the above objects and which further yet may be configured as a collapsible, portable and lightweight work table.

The invention achieves the above objects, and other objects and advantages that will become apparent from the description which follows, by providing a collapsible infeed/outfeed table having a generally A-frame configuration. The table includes a pair of foldable, laterally extensible work support surfaces in the form of wings that are pivotally connected to two pairs of foldable, elongated support legs. Each support leg pivotally supports a foldable strut having a first end pivotally connected to a corresponding support leg and a distal free end slidably connected to the foldable wing that corresponds to the connected leg.

In a preferred embodiment of the invention, the support legs and wings are pivotally connected to a pair of stanchions at an upper end thereof. A lower end of each stanchion is pivotally connected to a pair of foldable support braces having distal free ends that are slidably connected to the support legs. The stanchions may be provided with a telescoping roller that is retractable below the extended surface of the laterally extensible work support surfaces so as to provide an unobstructed upper surface for the table. This central roller may be raised to an extended position with the work support surfaces collapsed into their stowed positions such that the table may be used as an infeed/outfeed roller for a powered saw. The work support surfaces may also be provided at their free ends with a pair of extendable rollers that may be raised from the work support surfaces such that, when the central roller is retracted, a powered saw, such as a chop saw, miter saw, or the like may be positioned centrally on the table, with the rollers on the work support surfaces acting as the infeed/outfeed rollers. The collapsible infeed/outfeed table is thus capable of serving as an infeed/outfeed roller support (with the central roller extended, and the laterally extensible work support surfaces collapsed); a collapsible work table (with the laterally extensible work support surfaces extended and all of the rollers retracted); and a powered saw support stand (with the laterally extensible work support surfaces extended, the central roller retracted, and the rollers at the end of the work support surfaces extended). In any event, the entire table can be collapsed into a convenient form for carrying and storage.

DETAILED DESCRIPTION OF THE PREFERRED EMBODIMENTS

Figure 1:
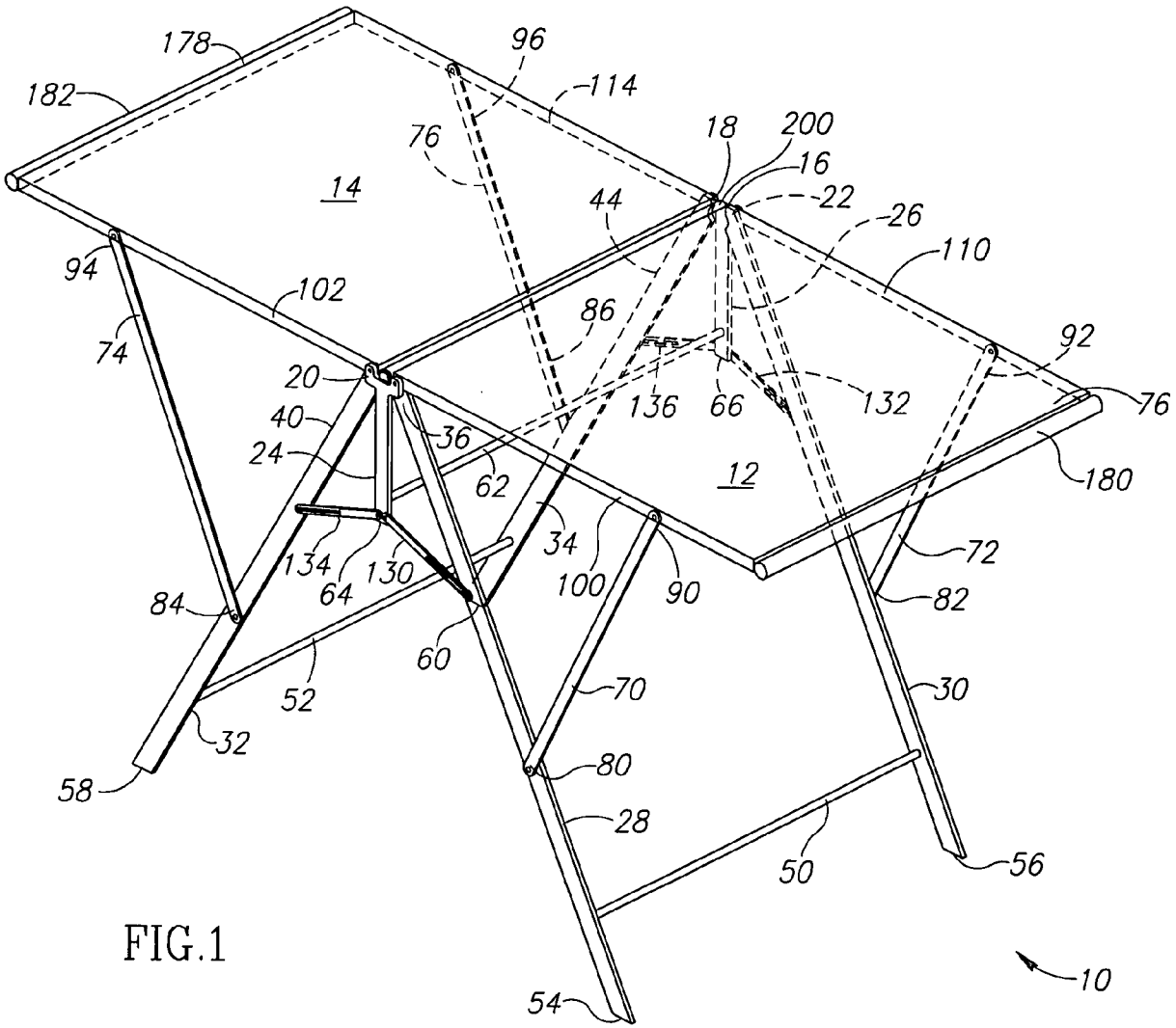
FIG. 1 is an isometric, top right perspective view of a collapsible infeed/outfeed table in accordance with the present invention.
Figure 2:
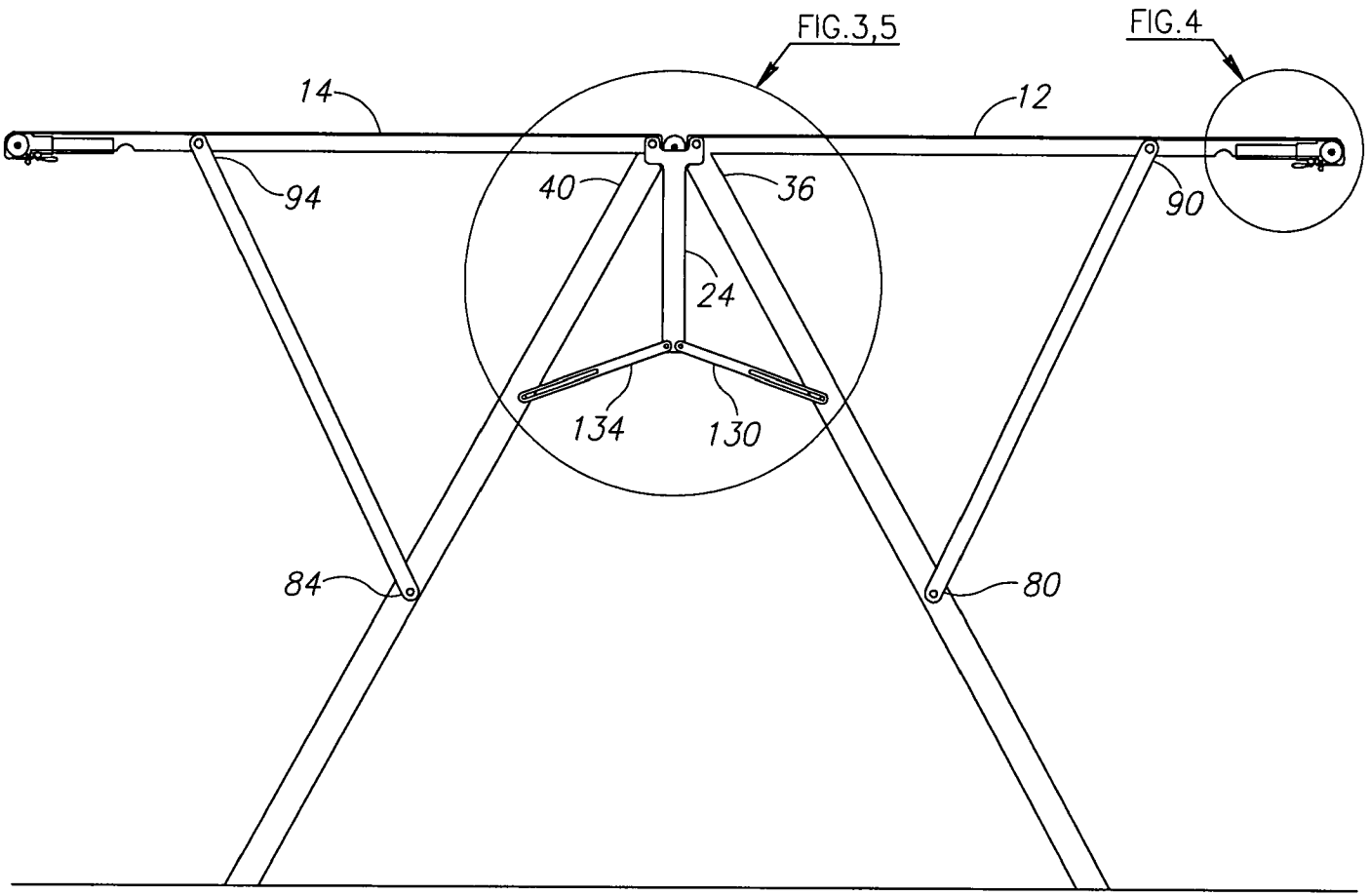
FIG. 2 is a side elevational view of the table shown in FIG. 1.

A collapsible infeed/outfeed table in accordance with the principles of the invention is generally indicated at reference numeral 10 in the various Figures of the attached drawings wherein numbered elements in the Figures correspond to like numbered elements herein.

Figure 3:
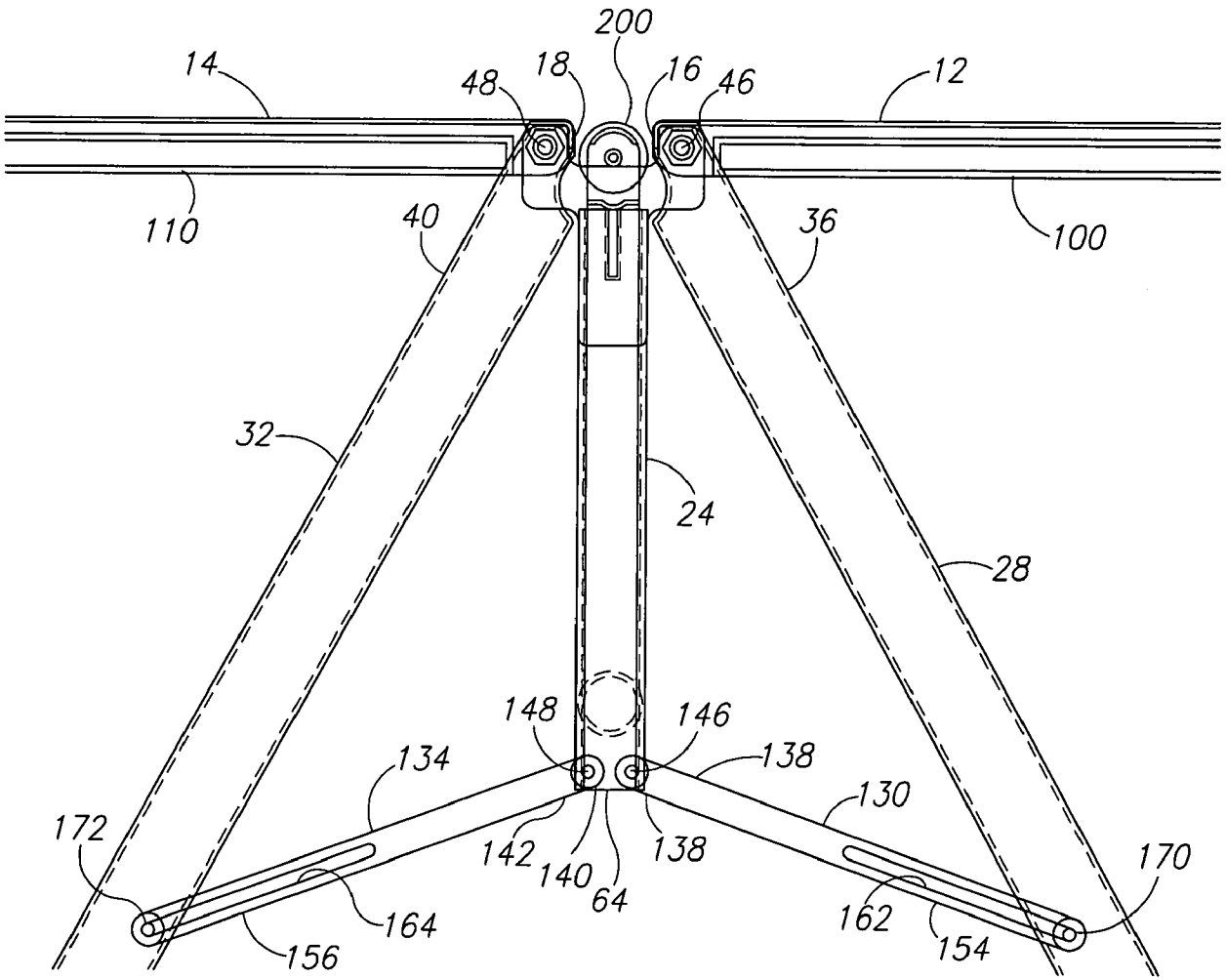
FIG. 3 is an enlarged, partial side elevational view of circled area 3 in FIG. 2.

The table 10 has a pair of selectively foldable, laterally extensible work support surfaces or wings 12, 14 that may be used to support work materials, a powered crosscut type of saw (e.g., a miter saw, sliding compound crosscut saw, compact powered band saw, etc.) or as a support for rollers for purposes that will be described hereinbelow. The wings are preferably manufactured from a sturdy material, such as sheet steel, and may be perforated (not shown) to prevent sheet materials, such as plywood from adhering thereto in response to a partial vacuum at a surface interface of the working material with the table. Each work surface has a corresponding inner end 16, 18 that is pivotally connected to bracket portions 20, 22 of a pair of vertical stanchions 24, 26 so that the wings 12, 14 may be pivoted between an extended position, shown in FIGS. 1 through 5, and a collapsed position (not shown) adjacent to two pairs of support legs 28, 30, 32, and 34. The support legs are elongated and have upper ends 36, 38, 40, and 44 that are coaxially pivotable about bracket portions 20, 22, such as by way of bolts 46, 48, as best seen in FIG. 3. The support legs are reinforced by support leg cross-braces 50, 52 adjacent to the free ends 54, 56, 58, and 60 of the corresponding support legs 28, 30, 32, and 34. Similarly, the stanchions 24, 26 are supported by a stanchion cross-brace 62 adjacent stanchion lower ends 64, 66.

Figure 4:
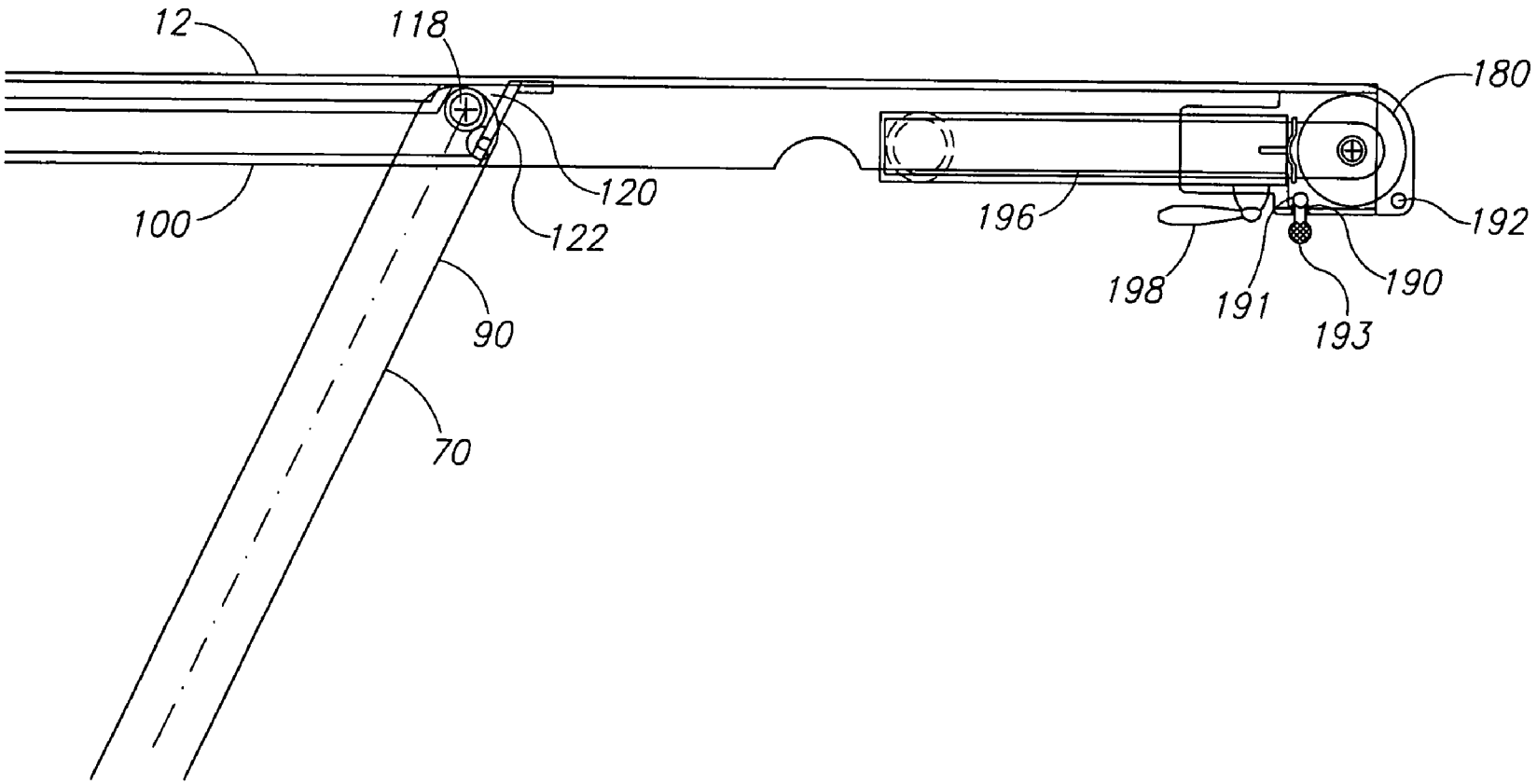
FIG. 4 is an enlarged, sectional side elevational view of the circled area 4 of FIG. 2.
Figure 5:
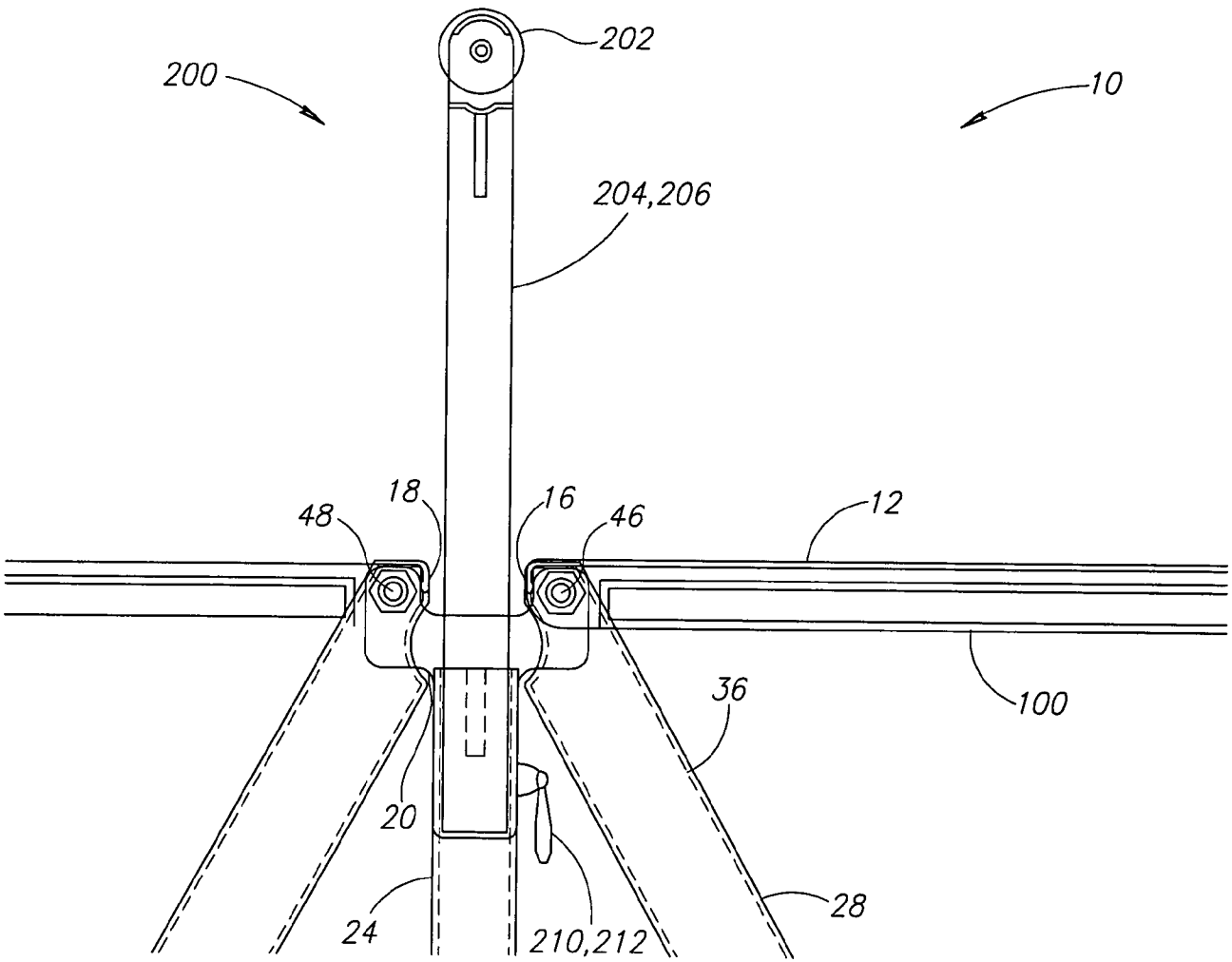
FIG. 5 is an enlarged, side elevational view similar to FIG. 3, showing the central roller in an extended position.

As will be apparent to those of ordinary skill in the art, the pivotal connection between the wings 12, 14, the elongated support legs 28, 30, 32, and 34, at the bracket portions 20, 22 of the stanchions 24, 26 permits the wings to be extendable to the position shown in the Figures, which is suitable for use as described above, and into a collapsed position (not shown) with the wings 12, 14 being nested against the support legs and the stanchions. In order to provide vertical load-bearing support for the wings 12, 14, the collapsible infeed/outfeed table 10 is provided with two pairs of wing support struts 70, 72, 74, and 76. The wing support struts each have a first end 80, 82, 84, and 86 pivotally connected to a corresponding support leg 28, 30, 32, and 34, such as by bolts (not shown). Each wing support strut also has a free end 90, 92, 94, and 96 that is slidably received in a corresponding wing track 100, 110, 112, and 114, best seen in FIGS. 3 and 4. Each strut free end 90 is provided with a transverse pin, such as transverse pin 118, which may reside in a detent area 120 secured by spring clip 122 so as to maintain the wings, for example, wing 12, in the extended position as shown in the Figures. As best seen in FIG. 4, the detent area 120 is configured such that a load on the wing 12 biases the pin 118 into the detent to prevent the wing from collapsing until the spring clip 122 is overcome by lifting the wing 12 vertically and then collapsing the corresponding wing support struts 70, 72 in a manner well understood by those of ordinary skill in the art.

In order to further stabilize the support legs 28, 30, 32, and 34, the lower ends 64, 66 of the stanchions 24, 26 are provided with a pair of leg support braces 130, 132, 134, and 136. Each leg support brace inner end 138, 140, 142, 144 is pivotally connected to the corresponding lower end 64 or 66 of the corresponding stanchion 24 or 26, such as by bolts 146, 148. Brace distal portions 154, 156, 158, and 160 are provided with corresponding elongated slots 162, 164 166, and 168, which are connected to portions of the corresponding support legs intermediate the stanchion bracket portions, 20, 22 and the first ends 80, 82, 84, 86 of the wing support struts 70, 72, 74, and 76. This arrangement permits the foldable legs to collapse or extend in a controlled manner and also provides significant lateral support for the table 10 when the wings 12, 14 are in the extended position shown in the Figures.

As will be apparent to those of ordinary skill in the art, the above fundamental structure of the collapsible infeed/outfeed table 10 provides a sturdy surface (when all of the above-described structural elements are in their extended positions) to support significant vertical loads. It will be appreciated that when the table is in its extended position shown in the Figures, and a load is placed on the work surface defined by the wings 12, 14 all of the structural members except the legs 28, 30, 32, 34; stanchions 24, 26 and wing support struts 70, 72, 74, 76 are in tension, providing for an extremely stable structure. In the preferred embodiment, each of these elements is made of formed sheet metal, such as steel, which has high strength in tension. Structural elements that are in compression, such as the legs, wing support struts and stanchions are either pivotally connected to another structure, (such as support legs 28, 30, 32, and 34) or are received in sliding tracks 100, 110, 112, and 114 in positions that are close to vertical so as to have significant rigidity in compression. As a consequence, the collapsible infeed/outfeed table 10 may be manufactured from relatively light-gauge steel and still have sufficient strength to support a heavy item, such as a powered chop saw, sliding crosscut saw, etc.

As will be apparent to those of ordinary skill in the art upon reviewing the above disclosure, the inherent strength of the table 10 assures that the table is well adapted for a variety of uses. When used to support a powered saw, such as a crosscut type of saw, the saw may be placed in the middle of the table. Advantageously, the wing free ends 176, 178 are provided with extensible roller structures 180, 182, best seen in FIG. 4. Each wing has on a lateral side thereof two apertures, 191, 192 that may be selectively engaged by a removable pin 193 so as to permit the extensible roller structure to achieve a vertical orientation with respect to the wing 12. The structure is provided with a telescoping mechanism 196 controlled by a clamp 198, allowing the roller 180 to be elevated above the surface of the wing 12 up to approximately 3 inches. The roller structures 180, 182 associated with the free end of each wing provide a relatively frictionless input and output surface elevated above the surface of the table to receive material that is to be crosscut on the powered saw (not shown). Similarly, the stanchions 24, 26 are also provided with a telescopic roller assembly 200, best seen in FIGS. 3 and 5. The roller assembly 200 includes an elongated roller 202 rotationally mounted on a pair of masts 204, 206 that nest inside each corresponding stanchion 24, 26. Conventional hand-operated clamps 210, 212 are provided on each stanchion 24, 26 to permit an operator to adjust the telescopic roller assembly 200 to a desired height from below the surface of the wings 12, 14 in the depressed area of the stanchion bracket portions 20, 22, up to approximately 6 inches above the surface of the wings 12, 14. In this manner, and with the wings 12, 14 collapsed, the table 10 can be used as an infeed, outfeed roller support with the configuration similar to that of a sawhorse with a conventional roller attached to the top thereof. Thus, the above, preferred embodiment of the invention is usable either as a work support table with all of the roller assemblies retracted and the wings extended, a crosscut saw support table with the central, telescopic assembly roller 200 retracted and the wing extensible roller structures 180, 182 extended, or as a roller infeed or outfeed support with the central telescopic roller assembly 200 extended and the wings 12, 14 collapsed.

Those of ordinary skill in the art will conceive of other alternate embodiments of the invention upon reviewing this disclosure. Thus, the invention is not to be limited to the above description, but is to be determined in scope by the claims which follow.

The invention claimed is:

1. A collapsible infeed/outfeed table, comprising:

a pair of central stanchions having upper and lower ends;

two pairs of foldable, elongated, support legs having upper ends pivotally attached adjacent to and substantially contiguous with the stanchion upper ends, the support legs also having distal free ends for supporting the table;

two pairs of foldable support braces, each brace having an inner end pivotally connected adjacent to a corresponding stanchion lower end and a distal portion slidably connected to a corresponding support leg;

two pairs of foldable struts, each strut having a first end pivotally connected to a corresponding support leg intermediate the support brace distal portions and the support leg free ends and further having a distal free end; and, two pairs of selectively foldable, laterally extensible, work support surfaces, each work support surface having an inner end pivotally connected to the stanchion upper ends, a distal free end, and a pair of tracks for slidably receiving corresponding strut free ends, whereby the table is convertible between a collapsed, stowed position and an extended operating position suitable for use as any one of a work table, a power tool stand, and an infeed/outfeed table.

2. The table of claim 1, including an outfeed/infeed roller connected to the distal free end of each work support surface.

3. The table of claim 2, wherein the rollers are pivotally connected to the work support surface distal free ends.

4. The table of claim 3, wherein the rollers are further telescopically connected to the work support surface free ends.

5. The table of claim 1, including a U-shaped bracket connected to the upper end of each central stanchion for pivotal receipt of the support leg upper ends.

6. The table of claim 5, including a stanchion roller telescopically connected to each central stanchion so as to be selectively positionable above and below the work support surfaces in their respective extended positions.

7. A collapsible output feed table, comprising:

a central stanchion having upper and lower ends;

a pair of foldable, elongated, support legs having upper ends pivotally attached adjacent the stanchion upper end and distal free ends for supporting the table;

a pair of foldable support braces, each brace having an inner end pivotally connected adjacent the stanchion lower end and a distal portion slidably connected to a corresponding support leg;

a pair of foldable wing struts, each strut having a first end pivotally connected to a corresponding support leg intermediate the support brace distal portions and the support leg free ends and a distal free end; and, a pair of selectively foldable, laterally extensible, work support surfaces, each work support surface having an inner end pivotally connected to the stanchion upper end, a distal free end, and a track for slidably receiving a corresponding strut free end, whereby the table is convertible between a collapsed, stowed position and an extended operating position suitable for use as any one of a work table, a power tool stand, and an infeed/outfeed table.

8. The table of claim 7, including an outfeed/infeed roller connected to the distal free end of each work support surface.

9. The table of claim 8, wherein the rollers are pivotally connected to the work support surface distal free ends.

10. The table of claim 9, wherein the rollers are further telescopically connected to the work support surface free ends.

11. The table of claim 10, including a stanchion roller telescopically connected to the central stanchion so as to be selectively positionable above and below the work support surfaces in their respective extended positions.

* * * * *